US009659540B1

(12) United States Patent
Mei

(10) Patent No.: US 9,659,540 B1
(45) Date of Patent: May 23, 2017

(54) GOA CIRCUIT OF REDUCING POWER CONSUMPTION

(71) Applicant: Shenzhen China Star Optoelectronics Technology Co., Ltd., Shenzhen (CN)

(72) Inventor: Wenlin Mei, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 133 days.

(21) Appl. No.: 14/778,616

(22) PCT Filed: Aug. 20, 2015

(86) PCT No.: PCT/CN2015/087657
§ 371 (c)(1),
(2) Date: Sep. 21, 2015

(87) PCT Pub. No.: WO2017/012160
PCT Pub. Date: Jan. 26, 2017

(30) Foreign Application Priority Data

Jul. 20, 2015 (CN) ..... 2015 1 0428629

(51) Int. Cl.
*G09G 3/3266* (2016.01)
*G09G 3/36* (2006.01)

(52) U.S. Cl.
CPC ..... *G09G 3/3648* (2013.01); *G09G 3/3674* (2013.01); *G09G 2300/0809* (2013.01); *G09G 2310/08* (2013.01); *G09G 2330/023* (2013.01)

(58) Field of Classification Search
CPC .. G09G 3/3266; G09G 3/3674–3/3681; G09G 2310/02–2310/0216; G09G 2310/0267; G09G 2310/0278–2310/0294
See application file for complete search history.

(56) References Cited

U.S. PATENT DOCUMENTS

2006/0001637 A1* 1/2006 Pak ..... G09G 3/3677 345/100
2015/0002382 A1* 1/2015 Cao ..... G09G 3/3677 345/92
2015/0194444 A1* 7/2015 Koo ..... H01L 27/124 257/43

* cited by examiner

*Primary Examiner* — Sanghyuk Park
(74) *Attorney, Agent, or Firm* — Leong C. Lei

(57) ABSTRACT

The present invention provides a GOA circuit of reducing power consumption. In the GOA unit circuit of the Nth stage, the twenty-second thin film transistor (T22) of the pull-up module (300) is controlled by the twenty-first thin film transistor (T21) of the second pull-up controlling and transmission module (200) to output the constant high voltage level (VDD) to the scan driving signal (G(N)) for reducing the parasitic capacitance of the clock signal, lowering the voltage level of the clock signal, easing the loading of the clock signal, and thus, to reduce the power consumption of the GOA circuit; the clock signal (CK(m)) is outputted to the stage transfer signal (ST(N)) through the twenty-first thin film transistor (T21), and the stage transfer signal (ST(N)) is employed for the transmission of the signal and the backward feedback to reduce the loading of the scan driving signal, and enhance the propulsive force of the scan driving signal, and the normal function of the GOA circuit can be ensured; and the forty-first thin film transistor (T41) is added in the pull-down holding module (700) to pull down the stage transfer signal (ST(N)) for preventing the electrical leakage of the twenty-second thin film transistor (T22).

13 Claims, 7 Drawing Sheets

| element | channel width (μm) | channel length (μm) |
|---|---|---|
| T11 | 200 | 5 |
| T21 | 2000 | 5 |
| T31 | 1000 | 5 |
| T32 | 300 | 5 |
| T33 | 300 | 5 |
| T51 | 200 | 5 |
| T52 | 200 | 5 |
| T61 | 100 | 5 |
| C1 | 1. 2PF | |
| C2 | 0. 6PF | |

Fig. 5

| element | channel width (μm) | channel length (μm) |
|---|---|---|
| T11 | 200 | 5 |
| T21 | 500 | 5 |
| T22 | 2000 | 5 |
| T31 | 1000 | 5 |
| T32 | 300 | 5 |
| T33 | 300 | 5 |
| T41 | 100 | 5 |
| T51 | 200 | 5 |
| T52 | 100 | 5 |
| T61 | 100 | 5 |
| C1 | 1. 2PF | |
| C2 | 0. 6PF | |

Fig. 6

GOA CIRCUIT OF REDUCING POWER CONSUMPTION

FIELD OF THE INVENTION

The present invention relates to a display technology field, and more particularly to a GOA circuit of reducing power consumption.

BACKGROUND OF THE INVENTION

The Liquid Crystal Display (LCD) possesses advantages of thin body, power saving and no radiation to be widely used in many application scope, such as LCD TV, mobile phone, personal digital assistant (PDA), digital camera, notebook, laptop, and dominates the flat panel display field.

Most of the liquid crystal displays on the present market are backlight type liquid crystal displays, which comprise a liquid crystal display panel and a backlight module. The working principle of the liquid crystal display panel is that the Liquid Crystal is injected between the Thin Film Transistor Array Substrate (TFT array substrate) and the Color Filter (CF). The light of backlight module is refracted to generate images by applying driving voltages to the two substrates for controlling the rotations of the liquid crystal molecules.

The Active Matrix Liquid Crystal Display (AMLCD) is the most common liquid crystal display device at present. The Active Matrix Liquid Crystal Display comprises a plurality of pixels, and each pixel comprises a Thin Film Transistor (TFT). The gate of the TFT is coupled to the scan line extending along the horizontal direction. The drain of the TFT is coupled to the data line extending along the vertical direction. The source of the TFT is coupled to the corresponding pixel electrode. When a sufficient positive voltage is applied to some scan line in the horizontal direction, all the TFT coupled to the scan line will be activated to write the data signal loaded in the data line into the pixel electrodes and thus to show images to control the transmittances of different liquid crystals to achieve the effect of controlling colors.

The driving of the level scan line (i.e. the gate driving) in the present active liquid crystal display is initially accomplished by the external Integrated Circuit (IC). The external IC can control the charge and discharge stage by stage of the level scan lines of respective stages. The GOA technology, i.e. the Gate Driver on Array technology can utilize the array manufacture processes of the liquid crystal display panel to manufacture the driving circuit of the level scan lines on the substrate around the active area, to replace the external IC for accomplishing the driving of the level scan lines. The GOA technology can reduce the bonding procedure of the external IC and has potential to raise the productivity and lower the production cost. Meanwhile, it can make the liquid crystal display panel more suitable to the narrow frame design of display products.

At present, the GOA technology has been widely applied in the liquid crystal display panel. However, the GOA circuit according to prior art has drawbacks of increasing power consumption in comparison with the externally connected IC. AS shown in FIG. 1, a GOA circuit according to prior art comprises a plurality of GOA unit circuits which are cascade connected, and in the GOA unit circuit of the Nth stage, both the gate and the source of the eleventh thin film transistor T11 receives the stage transfer signal ST(N−1) of the GOA unit circuit of the former N−1th stage to be in charge of pull-up control; the source of the twenty-first thin film transistor T21 receives a clock signal CK(m), and as the gate is at high voltage level, the twenty-first thin film transistor T21 is activated, and the drain outputs the clock signal CK(m) to be the scan driving signal G(N) to pull up the scan driving signal G(N).

The calculation formula of power consumption is:

$$P=\frac{1}{2}CfV^2$$

wherein P represents the power consumption, and f represents the frequency of the signal, and C represents the capacitance of the signal line, and V represents the high-low voltage level difference of the signal line. In the GOA circuit shown in FIG. 1, the frequency of the clock signal CK(m) is the highest, which is equal thousands times of other signal frequencies. This is the reason why the power consumption of the GOA circuit is larger, which mainly is generated by the clock signal CK(m). The power consumption, frequency of the signal, the capacitance of the signal line, the high-low voltage level difference of the signal line are in direct proportion, wherein the frequency is related to the resolution of the liquid crystal display panel and cannot be changed. Therefore, only the capacitance or the voltage difference can be decreased for reducing the power consumption.

Besides, the scan driving signal also needs to receive signals from the gate and the source of the eleventh thin film transistor T11 of the GOA unit circuit of the latter stage, and the loading of the scan driving signal G(N) is larger. Once the GOA circuit shown in FIG. 1 requires adjusting the high voltage level of the scan driving signal G(N) to enhance the propulsive force and the charge ability to the TFTs in the active area, it has to be achieved by raising the high voltage of the clock signal CK(m). Under such circumstance, it results in larger high-low voltage difference of the clock signal CK(m), and the power consumption of the GOA circuit is higher. However, if the high voltage of the clock signal CK(m) is not raised, then the propulsive force of the scan driving signal G(N) will be insufficient, which can easily cause the abnormal sequence of the scan driving signal G(N).

SUMMARY OF THE INVENTION

An objective of the present invention is to provide a GOA circuit capable of reducing the parasitic capacitance of the clock signal, lowering the voltage level of the clock signal, easing the loading of the clock signal, and thus, to reduce the power consumption of the GOA circuit, and preventing the abnormal sequence of the scan driving signal due to the insufficient propulsive force of the scan driving signal to ensure the normal function of the GOA circuit.

For realizing the aforesaid objective, the present invention provides a GOA circuit of reducing power consumption, comprising a plurality of GOA unit circuits which are cascade connected, and the GOA unit circuit of every stage comprises a first pull-up controlling module, a second pull-up controlling and transmission module, a pull-up module, a first pull-down module, a second pull-down module, a bootstrap capacitor module and a pull-down holding module, and each module comprises one or more thin film transistors;

N is set to be a positive integer and except the GOA unit circuit of the first stage and the GOA unit circuit of the last stage, in the GOA unit circuit of the Nth stage:

the first pull-up controlling module receives a stage transfer signal of the GOA unit circuit of the former N−1th stage, and is electrically coupled to a first node to control a voltage level of the first node;

the second pull-up controlling and transmission module is electrically coupled to the first node and the pull-up module, and the second pull-up controlling and transmission module receives a mth set of clock signal corresponding to the GOA unit circuit of the Nth stage to control the pull-up module according to the voltage level of the first node and a voltage level of the mth set of clock signal, and meanwhile outputs a stage transfer signal;

the pull-up module receives a constant high voltage level, and outputs a scan driving signal to output the constant high voltage level to the scan driving signal with being controlled by the second pull-up controlling and transmission module;

the first pull-down module receives a stage transfer signal of the GOA unit circuit of the latter N+1th stage and a m+1th set of clock signal corresponding to the GOA unit circuit of the latter N+1th stage, and is electrically coupled to the scan driving signal and a constant low voltage level to pull down a voltage level of the scan driving signal in a non-function period;

the second pull-down module receives the stage transfer signal of the GOA unit circuit of the latter N+1th stage, and is electrically coupled to the first node and the constant low voltage level to pull down the voltage level of the first node in the non-function period;

the bootstrap capacitor module is electrically coupled to the first node and the second pull-up controlling and transmission module to charge and discharge the first node;

the pull-down holding module is electrically coupled to the first node, the scan driving signal, the stage transfer signal, the mth set of clock signal and the constant low voltage level to maintain low voltage levels of the first node, the scan driving signal and the stage transfer signal in the non-function period;

the constant high voltage level is higher than a high voltage level of the clock signal;

the mth set of clock signal and the m+1th set of clock signal are inverse in phase.

The first pull-up controlling module comprises an eleventh thin film transistor, and both a gate and a source of the eleventh thin film transistor receives the stage transfer signal of the GOA unit circuit of the former N−1th stage, and a drain is electrically coupled to the first node;

the second pull-up controlling and transmission module comprises: a twenty-first thin film transistor, and a gate of the twenty-first thin film transistor is electrically coupled to the first node, and a source is electrically coupled to the mth set of clock signal corresponding to the GOA unit circuit of the Nth stage, and a drain outputs a stage transfer signal;

the pull-up module comprises a twenty-second thin film transistor, and a gate of the twenty-second thin film transistor is electrically coupled to the drain of the twenty-first thin film transistor, and a source receives the constant high voltage level, and a drain outputs the scan driving signal;

the first pull-down module comprises a thirty-first thin film transistor and a thirty-second thin film transistor; a gate of the thirty-first thin film transistor receives the stage transfer signal of the GOA unit circuit of the latter N+1th stage, and a source is electrically coupled to the scan driving signal, and a drain is electrically coupled to the constant low voltage level; a gate of the thirty-second thin film transistor receives the m+1th set of clock signal corresponding to the GOA unit circuit of the latter N+1th stage, and a source is electrically coupled to the scan driving signal, and a drain is electrically coupled to the constant low voltage level;

the second pull-down module comprises a fifty-first thin film transistor, and a gate of the fifty-first thin film transistor receives the stage transfer signal of the GOA unit circuit of the latter N+1th stage, and a source is electrically coupled to the first node, and a drain is electrically coupled to the constant low voltage level;

the bootstrap capacitor module comprises a first capacitor, and one end of the first capacitor is electrically coupled to the first node, and the other end is electrically coupled to the drain of the twenty-first thin film transistor;

the pull-down holding module comprises a forty-first thin film transistor, a sixty-first thin film transistor, a fifty-second thin film transistor, a second capacitor, and a thirty-third thin film transistor; a gate of the sixty-first thin film transistor is electrically coupled to the first node, and a source is electrically coupled to a second node, and a drain is electrically coupled to the constant low voltage level; a gate of the forty-first thin film transistor is electrically coupled to the second node, and a source is electrically coupled to the stage transfer signal, and a drain is electrically coupled to the constant low voltage level; a gate of the fifty-second thin film transistor is electrically coupled to the second node, and a source is electrically coupled to the first node, and a drain is electrically coupled to the constant low voltage level; one end of the second capacitor is electrically coupled to the mth set of clock signal corresponding to the GOA unit circuit of the Nth stage, and the other end is electrically coupled to the second node; a gate of the thirty-third thin film transistor is electrically coupled to the second node, and a source is electrically coupled to the scan driving signal, and a drain is electrically coupled to the constant low voltage level.

The high voltage level of the clock signal is 15V; the constant high voltage level is 25V.

Both the low voltage level of the clock signal and the constant low voltage level are −7V.

In the GOA unit circuit of the first stage, both the gate and the source of the eleventh thin film transistor receive a scan activation signal.

In the GOA unit circuit of the last stage, both the gate of the thirty-first thin film transistor and a gate of the fifty-first thin film transistor receive a scan activation signal.

The clock signal comprises two sets in total: a first set of clock signal and a second set of clock signal; as the mth set of clock signal is the second set of clock signal, the m+1th set of clock signal is the first set of clock signal.

A channel width of the twenty-first thin film transistor is 500 μm, and a channel width of the twenty-second thin film transistor is 2000 μm.

The present invention further provides a GOA circuit of reducing power consumption, comprising a plurality of GOA unit circuits which are cascade connected, and the GOA unit circuit of every stage comprises a first pull-up controlling module, a second pull-up controlling and transmission module, a pull-up module, a first pull-down module, a second pull-down module, a bootstrap capacitor module and a pull-down holding module, and each module comprises one or more thin film transistors;

N is set to be a positive integer and except the GOA unit circuit of the first stage and the GOA unit circuit of the last stage, in the GOA unit circuit of the Nth stage:

the first pull-up controlling module receives a stage transfer signal of the GOA unit circuit of the former N−1th stage, and is electrically coupled to a first node to control a voltage level of the first node;

the second pull-up controlling and transmission module is electrically coupled to the first node and the pull-up module, and the second pull-up controlling and transmission module receives a mth set of clock signal corresponding to the GOA unit circuit of the Nth stage to control the pull-up module according to the voltage level of the first node and a voltage level of the mth set of clock signal, and meanwhile outputs a stage transfer signal;

the pull-up module receives a constant high voltage level, and outputs a scan driving signal to output the constant high voltage level to the scan driving signal with being controlled by the second pull-up controlling and transmission module;

the first pull-down module receives a stage transfer signal of the GOA unit circuit of the latter N+1th stage and a m+1th set of clock signal corresponding to the GOA unit circuit of the latter N+1th stage, and is electrically coupled to the scan driving signal and a constant low voltage level to pull down a voltage level of the scan driving signal in a non-function period;

the second pull-down module receives the stage transfer signal of the GOA unit circuit of the latter N+1th stage, and is electrically coupled to the first node and the constant low voltage level to pull down the voltage level of the first node in the non-function period;

the bootstrap capacitor module is electrically coupled to the first node and the second pull-up controlling and transmission module to charge and discharge the first node;

the pull-down holding module is electrically coupled to the first node, the scan driving signal, the stage transfer signal, the mth set of clock signal and the constant low voltage level to maintain low voltage levels of the first node, the scan driving signal and the stage transfer signal in the non-function period;

the constant high voltage level is higher than a high voltage level of the clock signal;

the mth set of clock signal and the m+1th set of clock signal are inverse in phase;

wherein the first pull-up controlling module comprises an eleventh thin film transistor, and both a gate and a source of the eleventh thin film transistor receives the stage transfer signal of the GOA unit circuit of the former N−1th stage, and a drain is electrically coupled to the first node;

the second pull-up controlling and transmission module comprises: a twenty-first thin film transistor, and a gate of the twenty-first thin film transistor is electrically coupled to the first node, and a source is electrically coupled to the mth set of clock signal corresponding to the GOA unit circuit of the Nth stage, and a drain outputs a stage transfer signal;

the pull-up module comprises a twenty-second thin film transistor, and a gate of the twenty-second thin film transistor is electrically coupled to the drain of the twenty-first thin film transistor, and a source receives the constant high voltage level, and a drain outputs the scan driving signal;

the first pull-down module comprises a thirty-first thin film transistor and a thirty-second thin film transistor; a gate of the thirty-first thin film transistor receives the stage transfer signal of the GOA unit circuit of the latter N+1th stage, and a source is electrically coupled to the scan driving signal, and a drain is electrically coupled to the constant low voltage level; a gate of the thirty-second thin film transistor receives the m+1th set of clock signal corresponding to the GOA unit circuit of the latter N+1th stage, and a source is electrically coupled to the scan driving signal, and a drain is electrically coupled to the constant low voltage level;

the second pull-down module comprises a fifty-first thin film transistor, and a gate of the fifty-first thin film transistor receives the stage transfer signal of the GOA unit circuit of the latter N+1th stage, and a source is electrically coupled to the first node, and a drain is electrically coupled to the constant low voltage level;

the bootstrap capacitor module comprises a first capacitor, and one end of the first capacitor is electrically coupled to the first node, and the other end is electrically coupled to the drain of the twenty-first thin film transistor;

the pull-down holding module comprises a forty-first thin film transistor, a sixty-first thin film transistor, a fifty-second thin film transistor, a second capacitor, and a thirty-third thin film transistor; a gate of the sixty-first thin film transistor is electrically coupled to the first node, and a source is electrically coupled to a second node, and a drain is electrically coupled to the constant low voltage level; a gate of the forty-first thin film transistor is electrically coupled to the second node, and a source is electrically coupled to the stage transfer signal, and a drain is electrically coupled to the constant low voltage level; a gate of the fifty-second thin film transistor is electrically coupled to the second node, and a source is electrically coupled to the first node, and a drain is electrically coupled to the constant low voltage level; one end of the second capacitor is electrically coupled to the mth set of clock signal corresponding to the GOA unit circuit of the Nth stage, and the other end is electrically coupled to the second node; a gate of the thirty-third thin film transistor is electrically coupled to the second node, and a source is electrically coupled to the scan driving signal, and a drain is electrically coupled to the constant low voltage level;

wherein the high voltage level of the clock signal is 15V; the constant high voltage level is 25V;

wherein the clock signal comprises two sets in total: a first set of clock signal and a second set of clock signal; as the mth set of clock signal is the second set of clock signal, the m+1th set of clock signal is the first set of clock signal.

The benefits of the present invention are: the present invention provides a GOA circuit of reducing power consumption. By setting the first pull-up controlling module, the second pull-up controlling and transmission module, the pull-up module, the first pull-down module, the second pull-down module, the bootstrap capacitor module and the pull-down holding module in the GOA unit circuit of the Nth stage, the twenty-second thin film transistor of the pull-up module outputs the constant high voltage level to the scan driving signal with being controlled by the twenty-first thin film transistor of the second pull-up controlling and transmission module. In comparison with prior art, of which the clock signal is outputted to the scan driving signal, it is capable of reducing the parasitic capacitance of the clock signal, lowering the voltage level of the clock signal, easing the loading of the clock signal, and thus, to reduce the power consumption of the GOA circuit; the clock signal is outputted to the stage transfer signal through the twenty-first thin film transistor of the second pull-up controlling and transmission module, and the stage transfer signal is employed for the transmission of the signal and the backward feedback. In comparison with prior art, of which the scan driving signal is directly employed for the transmission of the signal and the backward feedback, it can reduce the loading of the scan driving signal, and enhance the propulsive force of the scan driving signal, and the normal function of the GOA circuit can be ensured; and the forty-first thin film transistor is added in the pull-down holding module to pull down the stage transfer signal for preventing the electrical leakage of the twenty-second thin film transistor.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings,

FIG. 5 is a dimension, specification table of respective TFT elements in the GOA circuit according to prior art;

FIG. 6 is a dimension, specification table of respective TFT elements in the GOA circuit of reducing power consumption according to the present invention;

DETAILED DESCRIPTION OF PREFERRED EMBODIMENTS

For better explaining the technical solution and the effect of the present invention, the present invention will be further described in detail with the accompanying drawings and the specific embodiments.

Figure 1:
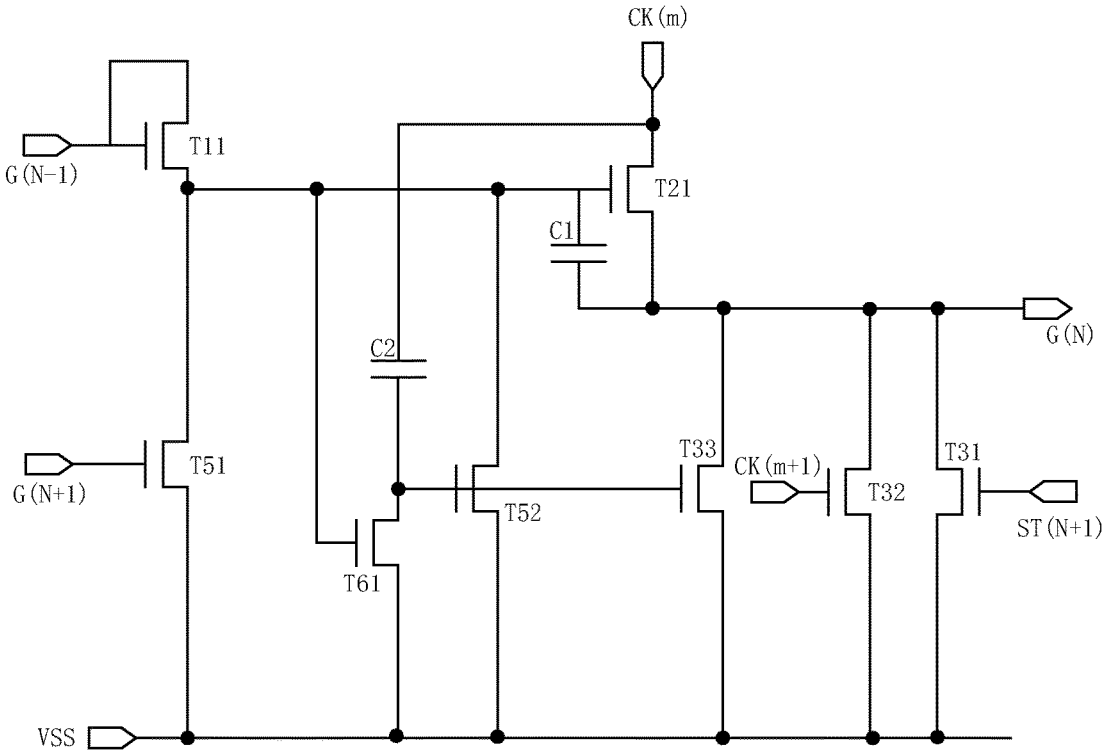
FIG. 1 is a circuit diagram of a GOA unit of the Nth stage of a GOA circuit according to prior art.
Figure 2:
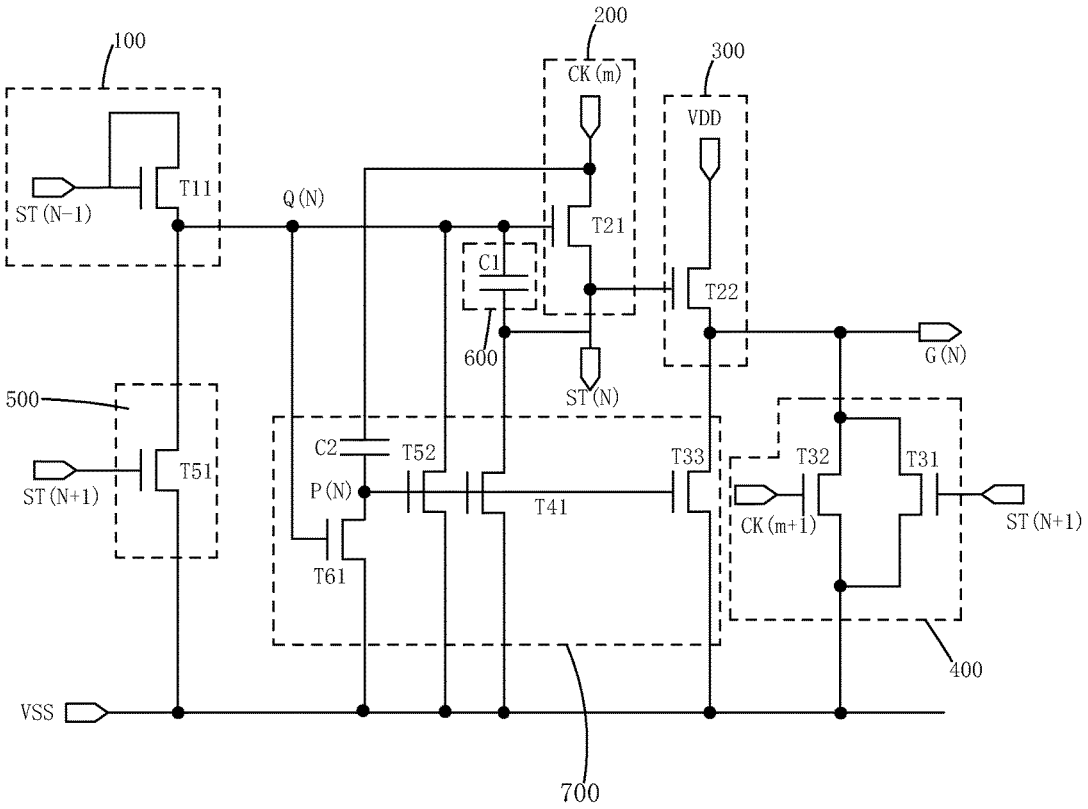
FIG. 2 is a circuit diagram of a GOA unit of the Nth stage of a GOA circuit of reducing power consumption according to the present invention.

Please refer to FIG. 2. The present invention provides a GOA circuit of reducing power consumption, comprising a plurality of GOA unit circuits which are cascade connected, and the GOA unit circuit of every stage comprises a first pull-up controlling module 100, a second pull-up controlling and transmission module 200, a pull-up module 300, a first pull-down module 400, a second pull-down module 500, a bootstrap capacitor module 600 and a pull-down holding module 700, and each module comprises one or more thin film transistors.

N is set to be a positive integer and except the GOA unit circuit of the first stage and the GOA unit circuit of the last stage, in the GOA unit circuit of the Nth stage:

the first pull-up controlling module 100 comprises an eleventh thin film transistor T11, and both a gate and a source of the eleventh thin film transistor T11 receives a stage transfer signal ST(N−1) of the GOA unit circuit of the former N−1th stage, and a drain is electrically coupled to the first node Q(N);

the second pull-up controlling and transmission module 200 comprises: a twenty-first thin film transistor T21, and a gate of the twenty-first thin film transistor T21 is electrically coupled to the first node Q(N), and a source is electrically coupled to an mth set of clock signal CK(m) corresponding to the GOA unit circuit of the Nth stage, and a drain outputs a stage transfer signal ST(N);

the pull-up module 300 comprises a twenty-second thin film transistor T22, and a gate of the twenty-second thin film transistor T22 is electrically coupled to the drain of the twenty-first thin film transistor T21, and a source receives the constant high voltage level VDD, and a drain outputs the scan driving signal G(N);

the first pull-down module 400 comprises a thirty-first thin film transistor T31 and a thirty-second thin film transistor T32; a gate of the thirty-first thin film transistor T31 receives the stage transfer signal ST(N−1) of the GOA unit circuit of the latter N+1th stage, and a source is electrically coupled to the scan driving signal G(N), and a drain is electrically coupled to the constant low voltage level VSS; a gate of the thirty-second thin film transistor T32 receives the m+1th set of clock signal CK(m+1) corresponding to the GOA unit circuit of the latter N+1th stage, and a source is electrically coupled to the scan driving signal G(N), and a drain is electrically coupled to the constant low voltage level VSS;

the second pull-down module 500 comprises a fifty-first thin film transistor T51, and a gate of the fifty-first thin film transistor T51 receives the stage transfer signal ST(N+1) of the GOA unit circuit of the latter N+1th stage, and a source is electrically coupled to the first node Q(N), and a drain is electrically coupled to the constant low voltage level VSS;

the bootstrap capacitor module 600 comprises a first capacitor C1, and one end of the first capacitor C1 is electrically coupled to the first node Q(N), and the other end is electrically coupled to the drain of the twenty-first thin film transistor T21;

the pull-down holding module 700 comprises a forty-first thin film transistor T41, a sixty-first thin film transistor T61, a fifty-second thin film transistor T52, a second capacitor C2, and a thirty-third thin film transistor T33; a gate of the sixty-first thin film transistor T61 is electrically coupled to the first node Q(N), and a source is electrically coupled to a second node P(N), and a drain is electrically coupled to the constant low voltage level VSS; a gate of the forty-first thin film transistor T41 is electrically coupled to the second node P(N), and a source is electrically coupled to the stage transfer signal ST(N), and a drain is electrically coupled to the constant low voltage level VSS; a gate of the fifty-second thin film transistor T52 is electrically coupled to the second node P(N), and a source is electrically coupled to the first node Q(N), and a drain is electrically coupled to the constant low voltage level VSS; one end of the second capacitor C2 is electrically coupled to the mth set of clock signal CK(m) corresponding to the GOA unit circuit of the Nth stage, and the other end is electrically coupled to the second node P(N); a gate of the thirty-third thin film transistor T33 is electrically coupled to the second node P(N), and a source is electrically coupled to the scan driving signal G(N), and a drain is electrically coupled to the constant low voltage level VSS.

Significantly, the constant high voltage level VDD is higher than a high voltage level of the clock signal. The mth set of clock signal CK(m) and the m+1th set of clock signal CK(m−1) are inverse in phase; the clock signal comprises two sets in total: a first set of clock signal CK(1) and a second set of clock signal CK(2); as the mth set of clock signal CK(m) is the second set of clock signal CK(2), the m+1th set of clock signal CK(m−1) is the first set of clock signal CK(1).

Figure 3:
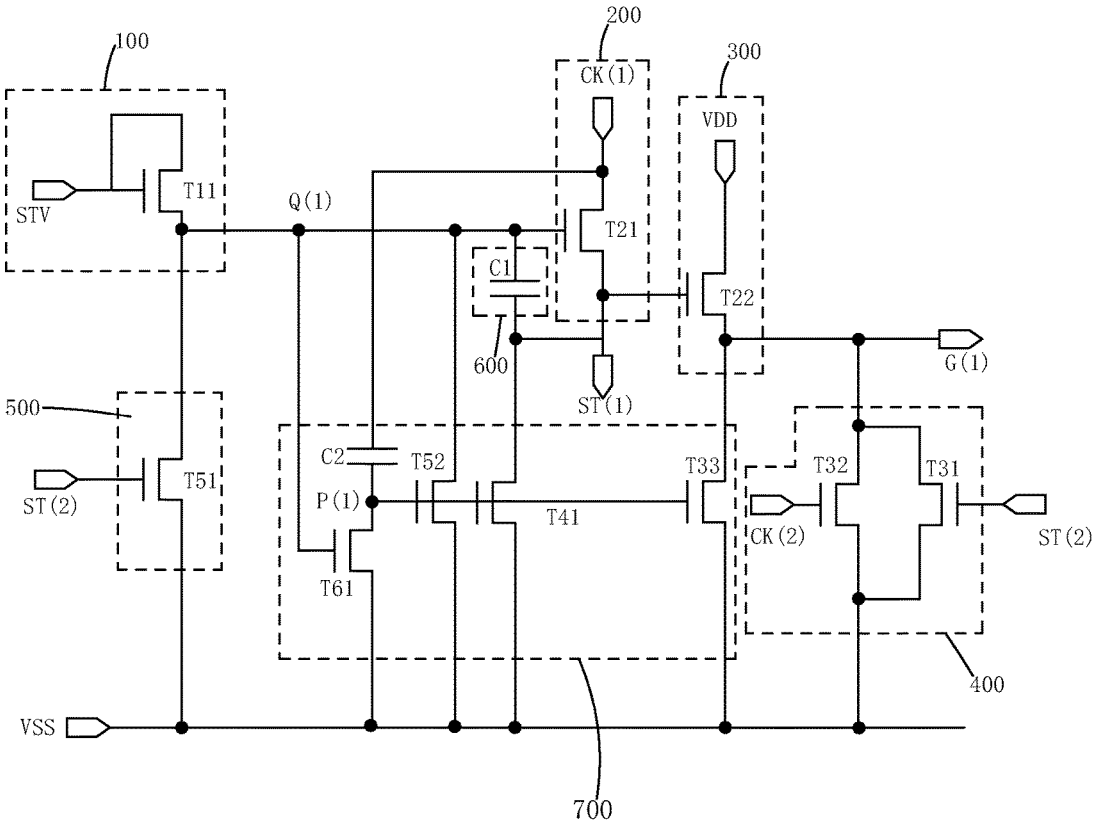
FIG. 3 is a circuit diagram of a GOA unit of the first stage of a GOA circuit of reducing power consumption according to the present invention.

Particularly, referring to FIG. 3, in the GOA unit circuit of the first stage, both the gate and the source of the eleventh thin film transistor T11 receives a scan activation signal STV, and both the source of the twenty-first thin film transistor T21 and the one end of the second capacitor C2 are electrically coupled to the first set of clock signal CK(1), and the gate of the thirty-second thin film transistor T32 receives the second set of clock signal CK(2).

Figure 4:
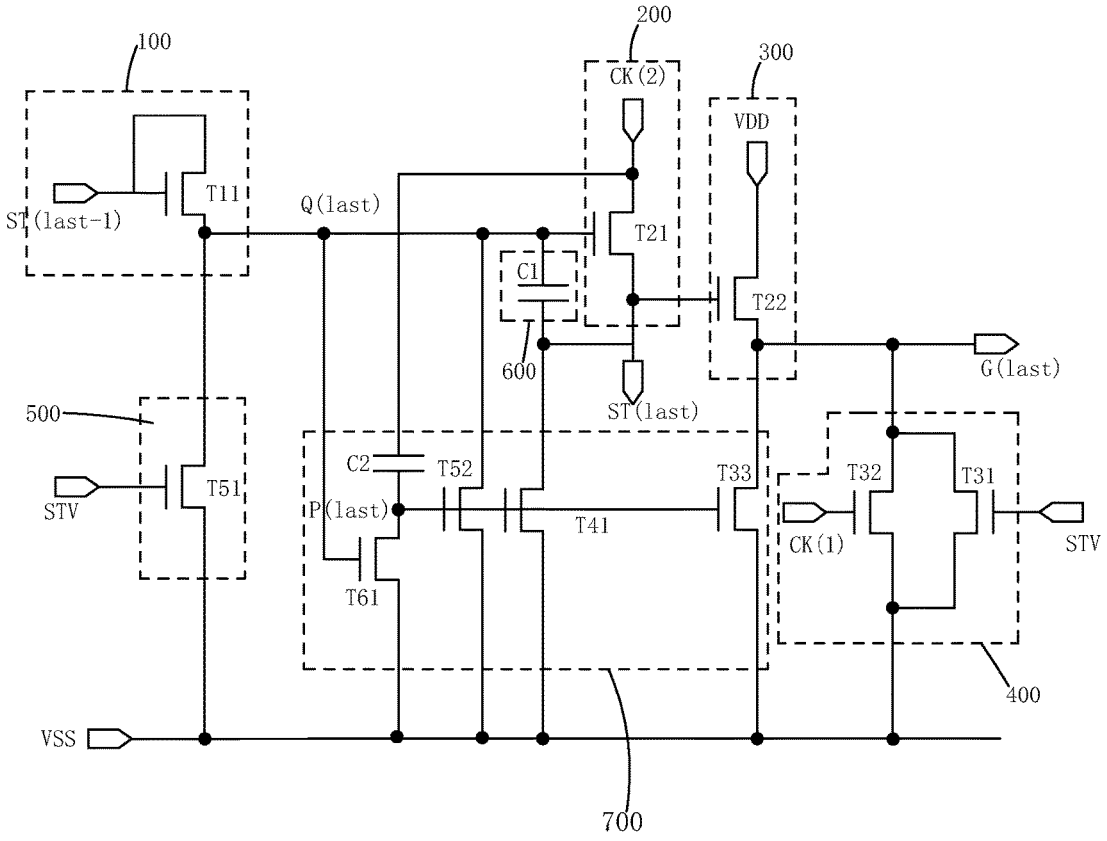
FIG. 4 is a circuit diagram of a GOA unit of the last stage of a GOA circuit of reducing power consumption according to the present invention.

Please refer to FIG. 4. In the GOA unit circuit of the last stage, both the gate of the thirty-first thin film transistor T31 and a gate of the fifty-first thin film transistor T51 receives a scan activation signal STV, and both the source of the twenty-first thin film transistor T21 and the one end of the second capacitor C2 are electrically coupled to the second set of clock signal CK(2), and the gate of the thirty-second thin film transistor T32 receives the first set of clock signal CK(1).

Figure 7:
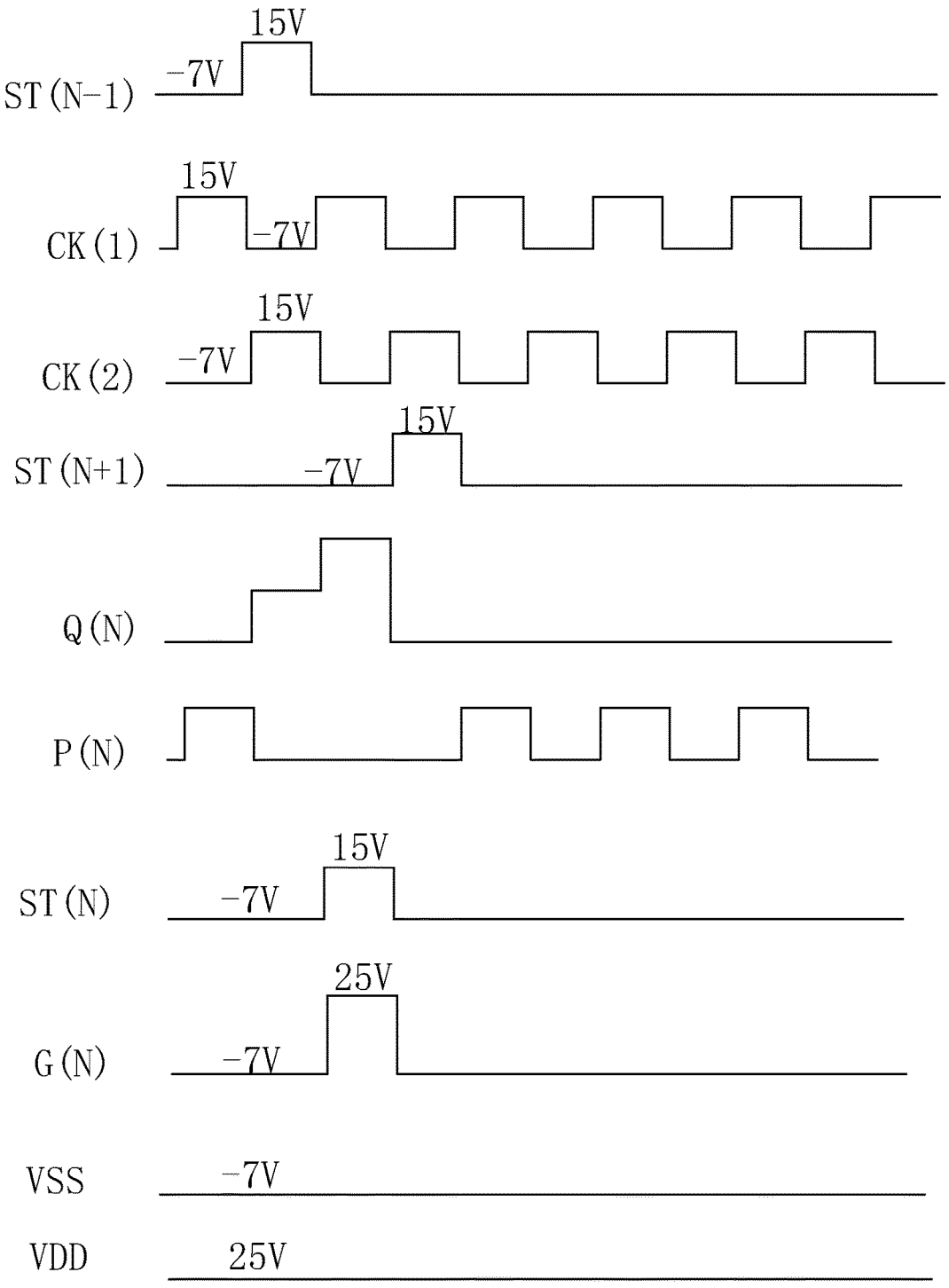
FIG. 7 is a waveform diagram of the input signals and the key nodes of a GOA circuit of reducing power consumption according to the present invention.

Please refer to FIG. 2 and FIG. 7 at the same time. The working procedure of the GOA unit circuit of reducing power consumption according to the present invention is: the scan activation signal STV activates the GOA unit circuit of the first stage, and then performs scan driving sequentially stage by stage. When the scan driving is performed to the GOA unit circuit of the Nth stage, and the stage transfer signal ST(N−1) of the GOA unit circuit of the former N−1th stage is high voltage level, the eleventh thin film transistor T11 is activated, and the first node Q(N) is raised to the high voltage level to charge the first capacitor C1. Then, the stage transfer signal ST(N−1) of the GOA unit circuit of the former N−1th stage is changed to be low voltage level, and the eleventh thin film transistor T11 is deactivated, and the first node Q(N) is kept at high voltage level through the first capacitor C1 to activate the twenty-first thin film transistor T21. Then, the mth set of clock signal CK(m) corresponding to the GOA unit circuit of the Nth stage is changed to be high voltage level, and the twenty-first thin film transistor T21 outputs the high voltage level of the mth set of clock signal CK(m) to the stage transfer signal ST(N), and also transmits the mth set of clock signal CK(m) to the gate of the twenty-second thin film transistor T22 to control the twenty-second thin film transistor T22 to be activated. Accordingly, the twenty-second thin film transistor T22 outputs the constant high voltage level VDD to the scan driving signal G(N), i.e. the scan driving signal G(N) is pulled up to the constant high voltage level VDD. Meanwhile, the mth set of clock signal CK(m) keeps charging the first capacitor C1 through the twenty-first thin film transistor T21 to raise the first node Q(N) to a higher voltage level. Then, the twenty-second thin film transistor T22 is deactivated as the mth set of clock signal CK(m) is changed to be low voltage level. Along with that the m+1th set of clock signal CK(m−1) corresponding to the GOA unit circuit of the latter N+1th stage or the stage transfer signal ST(N−1) is changed to be high voltage level, the thirty-first thin film transistor T31 or the thirty-second thin film transistor T32 is activated to pull down the scan driving signal G(N) to the constant low voltage level VSS, and meanwhile, the first node Q(N) is discharged through the fifty-first thin film transistor T51 to be pulled down to the constant low voltage level VSS.

In the functioning period, the first node Q(N) is high voltage level, and the sixty-first thin film transistor T61 is activated to pull down the voltage level of the second node P(N) to the constant low voltage level VSS. The thirty-third thin film transistor T33, the forty-first thin film transistor T41 and the fifty-second thin film transistor T52 are deactivated to ensure that ensure that the scan driving signal G(N) and the stage transfer signal ST(N) steadily output high voltage levels.

In the non-functioning period, the thirty-first thin film transistor T31 and the thirty-second thin film transistor T32 take turns to pull down the scan driving signal G(N) to make the TFTs in the Active Area (AA) to be kept in an off state after the charge is accomplished. At this moment, the sixty-first thin film transistor T61 is deactivated, and the mth set of clock signal CK(m) is changed to be high voltage level, again. The second node P(N) is high voltage level with the charge function of the second capacitor C2 to control the thirty-third thin film transistor T33, the forty-first thin film transistor T41 and the fifty-second thin film transistor T52 to be activated to ensure that ensure that the scan driving signal G(N) and the stage transfer signal ST(N) steadily output low voltage levels. Furthermore, because the forty-first thin film transistor T41 pulls down the stage transfer signal ST(N) to the constant low voltage level VSS to prevent that the twenty-second thin film transistor T22 is not deactivated enough and the constant high voltage level VDD leaks to the scan driving signal G(N).

Particularly, the twenty-second thin film transistor T22 is added to the GOA circuit of reducing power consumption according to the present invention, and the twenty-second thin film transistor T22 receives the constant high voltage level VDD. As the twenty-first thin film transistor T21 is activated and the mth set of clock signal CK(m) is high voltage level, the twenty-second thin film transistor T22 is activated to output the constant high voltage level VDD to the scan driving signal G(N). Therefore, the voltage level of the scan driving signal G(N) can be raised by adjusting the constant high voltage level VDD to realize enhancing the driving ability of the GOA circuit and increasing the activation current of TFTs in the AA to enhance the charge ability. In comparison with prior art, of which the high voltage level of the mth set of clock signal CK(m) is outputted to the scan driving signal G(N) through the twenty-first thin film transistor T21, it can be avoided to enhance the propulsive force and the charge ability by raising the high voltage level of the clock signal. Thus, it is capable of lowering the voltage level of the clock signal, easing the loading of the clock signal to reduce the power consumption of the GOA circuit.

The GOA circuit of reducing power consumption according to the present invention adds the stage transfer signal ST(N) to be employed for the transmission of the signal and the backward feedback. In comparison with prior art, of which the scan driving signal G(N) is employed for the transmission of the signal and the backward feedback, it can reduce the loading of the scan driving signal G(N), and meanwhile, enhance the propulsive force of the scan driving signal G(N), and the distortion of the stage transfer signal ST(N) is slighter to prevent the difference of the former, latter GOA circuits caused by the distortion of the scan driving signal G(N).

Please compare FIG. 5 and FIG. 6. The channel width of the twenty-first thin film transistor T21 which receives the clock signal in the GOA circuit according to prior art is 2000 μm. In the GOA circuit of reducing power consumption according to the present invention, the channel width of the twenty-first thin film transistor T21 which receives the clock signal is only 500 μm, which is ¼ of prior art. Therefore, the parasitic capacitance between the twenty-first thin film transistor T21 and the clock signal in the GOA circuit of reducing power consumption according to the present invention is also ¼ of the GOA circuit according to prior art. The parasitic capacitance of the clock signal line is mostly generated by the twenty-first thin film transistor T21. The present invention can reduce nearly ¾ of the parasitic capacitance of the clock signal line. According to the power consumption formula, $P=\frac{1}{2}CfV^2$, the power consumption of the GOA circuit can be effectively reduced.

Please refer to FIG. 7, which is a waveform diagram of the input signals and the key nodes of a GOA circuit of reducing power consumption according to the present invention. As shown in waveforms, the stage transfer signal ST(N) and the scan driving signal G(N) are synchronous but merely the high voltage levels are different.

In the GOA circuit according to prior art, the high voltage level of the clock signal is 25V, and all the low voltage levels are −7V. In the GOA circuit of reducing power consumption according to the present invention, the constant high voltage level VDD is 25V, and the constant low voltage level VSS is −7V, and the high voltage level of the clock signal is 15V, and all the low voltage levels are −7V. Because the high voltage level of the clock signal is reduced, the ratio of the power consumptions of the clock signals of the GOA circuit of reducing power consumption according to the present invention and the GOA circuit according to prior art can be calculated with the following equation:

$$(15+7)2/(25+7)2=47.26\%$$

In comparison with the GOA circuit according to prior art, the GOA circuit of reducing power consumption according to the present invention can reduce nearly 50% power consumption of the clock signal under circumstance of without influencing the propulsive force of the GOA circuit.

In conclusion, the present invention provides a GOA circuit of reducing power consumption. By setting the first pull-up controlling module, the second pull-up controlling and transmission module, the pull-up module, the first pull-down module, the second pull-down module, the bootstrap capacitor module and the pull-down holding module in the GOA unit circuit of the Nth stage, the twenty-second thin film transistor of the pull-up module outputs the constant high voltage level to the scan driving signal with being controlled by the twenty-first thin film transistor of the second pull-up controlling and transmission module. In comparison with prior art, of which the clock signal is outputted to the scan driving signal, it is capable of reducing the parasitic capacitance of the clock signal, lowering the voltage level of the clock signal, easing the loading of the clock signal, and thus, to reduce the power consumption of the GOA circuit; the clock signal is outputted to the stage transfer signal through the twenty-first thin film transistor of the second pull-up controlling and transmission module, and the stage transfer signal is employed for the transmission of the signal and the backward feedback. In comparison with prior art, of which the scan driving signal is directly employed for the transmission of the signal and the backward feedback, it can reduce the loading of the scan driving signal, and enhance the propulsive force of the scan driving signal, and the normal function of the GOA circuit can be ensured; and the forty-first thin film transistor is added in the pull-down holding module to pull down the stage transfer signal for preventing the electrical leakage of the twenty-second thin film transistor.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A GOA circuit of reducing power consumption, comprising a plurality of GOA unit circuits which are cascade connected, and the GOA unit circuit of every stage comprises a first pull-up controlling module, a second pull-up controlling and transmission module, a pull-up module, a first pull-down module, a second pull-down module, a bootstrap capacitor module and a pull-down holding module, and each module comprises one or more thin film transistors;

N is set to be a positive integer and except the GOA unit circuit of the first stage and the GOA unit circuit of the last stage, in the GOA unit circuit of an Nth stage:

the first pull-up controlling module receives a stage transfer signal of the GOA unit circuit of a former N−1th stage, and is electrically coupled to a first node to control a voltage level of the first node;

the second pull-up controlling and transmission module is electrically coupled to the first node and the pull-up module, and the second pull-up controlling and transmission module receives a mth set of clock signal corresponding to the GOA unit circuit of the Nth stage to control the pull-up module according to the voltage level of the first node and a voltage level of the mth set of clock signal, and meanwhile outputs a stage transfer signal;

the pull-up module receives a constant high voltage level, and outputs a scan driving signal to output the constant high voltage level to the scan driving signal with being controlled by the second pull-up controlling and transmission module;

the first pull-down module receives a stage transfer signal of the GOA unit circuit of a latter N+1th stage and a m+1th set of clock signal corresponding to the GOA unit circuit of the latter N+1th stage, and is electrically coupled to the scan driving signal and a constant low voltage level to pull down a voltage level of the scan driving signal in a non-function period;

the second pull-down module receives the stage transfer signal of the GOA unit circuit of the latter N+1th stage, and is electrically coupled to the first node and the constant low voltage level to pull down the voltage level of the first node in the non-function period;

the bootstrap capacitor module is electrically coupled to the first node and the second pull-up controlling and transmission module to charge and discharge the first node;

the pull-down holding module is electrically coupled to the first node, the scan driving signal, the stage transfer signal, the mth set of clock signal and the constant low voltage level to maintain low voltage levels of the first node, the scan driving signal and the stage transfer signal in the non-function period;

the constant high voltage level is higher than a high voltage level of the clock signal;

the mth set of clock signal and the m+1th set of clock signal are inverse in phase.

2. The GOA circuit of reducing power consumption according to claim 1, wherein the first pull-up controlling module comprises an eleventh thin film transistor, and both a gate and a source of the eleventh thin film transistor receives the stage transfer signal of the GOA unit circuit of the former N−1th stage, and a drain is electrically coupled to the first node;

the second pull-up controlling and transmission module comprises: a twenty-first thin film transistor, and a gate of the twenty-first thin film transistor is electrically coupled to the first node, and a source is electrically coupled to the mth set of clock signal corresponding to the GOA unit circuit of the Nth stage, and a drain outputs a stage transfer signal;

the pull-up module comprises a twenty-second thin film transistor, and a gate of the twenty-second thin film transistor is electrically coupled to the drain of the twenty-first thin film transistor, and a source receives the constant high voltage level, and a drain outputs the scan driving signal;

the first pull-down module comprises a thirty-first thin film transistor and a thirty-second thin film transistor; a gate of the thirty-first thin film transistor receives the stage transfer signal of the GOA unit circuit of the latter N+1th stage, and a source is electrically coupled to the scan driving signal, and a drain is electrically coupled to the constant low voltage level; a gate of the thirty-second thin film transistor receives the m+1th set of clock signal corresponding to the GOA unit circuit of the latter N+1th stage, and a source is electrically coupled to the scan driving signal, and a drain is electrically coupled to the constant low voltage level;

the second pull-down module comprises a fifty-first thin film transistor, and a gate of the fifty-first thin film transistor receives the stage transfer signal of the GOA unit circuit of the latter N+1th stage, and a source is electrically coupled to the first node, and a drain is electrically coupled to the constant low voltage level;

the bootstrap capacitor module comprises a first capacitor, and one end of the first capacitor is electrically coupled to the first node, and the other end is electrically coupled to the drain of the twenty-first thin film transistor;

the pull-down holding module comprises a forty-first thin film transistor, a sixty-first thin film transistor, a fifty-second thin film transistor, a second capacitor, and a thirty-third thin film transistor; a gate of the sixty-first thin film transistor is electrically coupled to the first node, and a source is electrically coupled to a second node, and a drain is electrically coupled to the constant low voltage level; a gate of the forty-first thin film transistor is electrically coupled to the second node, and a source is electrically coupled to the stage transfer signal, and a drain is electrically coupled to the constant low voltage level; a gate of the fifty-second thin film transistor is electrically coupled to the second node, and a source is electrically coupled to the first node, and a drain is electrically coupled to the constant low voltage level; one end of the second capacitor is electrically coupled to the mth set of clock signal corresponding to the GOA unit circuit of the Nth stage, and the other end is electrically coupled to the second node; a gate of the thirty-third thin film transistor is electrically coupled to the second node, and a source is electrically coupled to the scan driving signal, and a drain is electrically coupled to the constant low voltage level.

3. The GOA circuit of reducing power consumption according to claim 2, wherein in the GOA unit circuit of the first stage, both the gate and the source of the eleventh thin film transistor receive a scan activation signal.

4. The GOA circuit of reducing power consumption according to claim 2, wherein in the GOA unit circuit of the last stage, both the gate of the thirty-first thin film transistor and a gate of the fifty-first thin film transistor receives a scan activation signal.

5. The GOA circuit of reducing power consumption according to claim 2, wherein a channel width of the twenty-first thin film transistor is 500 μm, and a channel width of the twenty-second thin film transistor is 2000 μm.

6. The GOA circuit of reducing power consumption according to claim 1, wherein the high voltage level of the clock signal is 15V; the constant high voltage level is 25V.

7. The GOA circuit of reducing power consumption according to claim 6, wherein both the low voltage level of the clock signal and the constant low voltage level are −7V.

8. The GOA circuit of reducing power consumption according to claim 1, wherein the clock signal comprises two sets in total: a first set of clock signal and a second set of clock signal; as the mth set of clock signal is the second set of clock signal, the m+1th set of clock signal is the first set of clock signal.

9. A GOA circuit of reducing power consumption, comprising a plurality of GOA unit circuits which are cascade connected, and the GOA unit circuit of every stage comprises a first pull-up controlling module, a second pull-up controlling and transmission module, a pull-up module, a first pull-down module, a second pull-down module, a bootstrap capacitor module and a pull-down holding module, and each module comprises one or more thin film transistors;

N is set to be a positive integer and except the GOA unit circuit of the first stage and the GOA unit circuit of the last stage, in the GOA unit circuit of an Nth stage:

the first pull-up controlling module receives a stage transfer signal of the GOA unit circuit of a former N−1th stage, and is electrically coupled to a first node to control a voltage level of the first node;

the second pull-up controlling and transmission module is electrically coupled to the first node and the pull-up module, and the second pull-up controlling and transmission module receives a mth set of clock signal corresponding to the GOA unit circuit of the Nth stage to control the pull-up module according to the voltage level of the first node and a voltage level of the mth set of clock signal, and meanwhile outputs a stage transfer signal;

the pull-up module receives a constant high voltage level, and outputs a scan driving signal to output the constant high voltage level to the scan driving signal with being controlled by the second pull-up controlling and transmission module;

the first pull-down module receives a stage transfer signal of the GOA unit circuit of a latter N+1th stage and a m+1th set of clock signal corresponding to the GOA unit circuit of the latter N+1th stage, and is electrically coupled to the scan driving signal and a constant low voltage level to pull down a voltage level of the scan driving signal in a non-function period;

the second pull-down module receives the stage transfer signal of the GOA unit circuit of the latter N+1th stage, and is electrically coupled to the first node and the constant low voltage level to pull down the voltage level of the first node in the non-function period;

the bootstrap capacitor module is electrically coupled to the first node and the second pull-up controlling and transmission module to charge and discharge the first node;

the pull-down holding module is electrically coupled to the first node, the scan driving signal, the stage transfer signal, the mth set of clock signal and the constant low voltage level to maintain low voltage levels of the first node, the scan driving signal and the stage transfer signal in the non-function period;

the constant high voltage level is higher than a high voltage level of the clock signal;

the mth set of clock signal and the m+1th set of clock signal are inverse in phase;

wherein the first pull-up controlling module comprises an eleventh thin film transistor, and both a gate and a source of the eleventh thin film transistor receives the stage transfer signal of the GOA unit circuit of the former N−1th stage, and a drain is electrically coupled to the first node;

the second pull-up controlling and transmission module comprises: a twenty-first thin film transistor, and a gate of the twenty-first thin film transistor is electrically coupled to the first node, and a source is electrically coupled to the mth set of clock signal corresponding to the GOA unit circuit of the Nth stage, and a drain outputs a stage transfer signal;

the pull-up module comprises a twenty-second thin film transistor, and a gate of the twenty-second thin film transistor is electrically coupled to the drain of the twenty-first thin film transistor, and a source receives the constant high voltage level, and a drain outputs the scan driving signal;

the first pull-down module comprises a thirty-first thin film transistor and a thirty-second thin film transistor; a gate of the thirty-first thin film transistor receives the stage transfer signal of the GOA unit circuit of the latter N+1th stage, and a source is electrically coupled to the scan driving signal, and a drain is electrically coupled to the constant low voltage level; a gate of the thirty-second thin film transistor receives the m+1th set of clock signal corresponding to the GOA unit circuit of the latter N+1th stage, and a source is electrically coupled to the scan driving signal, and a drain is electrically coupled to the constant low voltage level;

the second pull-down module comprises a fifty-first thin film transistor, and a gate of the fifty-first thin film transistor receives the stage transfer signal of the GOA unit circuit of the latter N+1th stage, and a source is electrically coupled to the first node, and a drain is electrically coupled to the constant low voltage level;

the bootstrap capacitor module comprises a first capacitor, and one end of the first capacitor is electrically coupled to the first node, and the other end is electrically coupled to the drain of the twenty-first thin film transistor;

the pull-down holding module comprises a forty-first thin film transistor, a sixty-first thin film transistor, a fifty-second thin film transistor, a second capacitor, and a thirty-third thin film transistor; a gate of the sixty-first thin film transistor is electrically coupled to the first node, and a source is electrically coupled to a second node, and a drain is electrically coupled to the constant low voltage level; a gate of the forty-first thin film transistor is electrically coupled to the second node, and a source is electrically coupled to the stage transfer signal, and a drain is electrically coupled to the constant low voltage level; a gate of the fifty-second thin film transistor is electrically coupled to the second node, and a source is electrically coupled to the first node, and a drain is electrically coupled to the constant low voltage level; one end of the second capacitor is electrically coupled to the mth set of clock signal corresponding to the GOA unit circuit of the Nth stage, and the other end is electrically coupled to the second node; a gate of the thirty-third thin film transistor is electrically coupled to the second node, and a source is electrically coupled to the scan driving signal, and a drain is electrically coupled to the constant low voltage level;

wherein the high voltage level of the clock signal is 15V; the constant high voltage level is 25V;

wherein the clock signal comprises two sets in total: a first set of clock signal and a second set of clock signal; as the mth set of clock signal is the second set of clock signal, the m+1th set of clock signal is the first set of clock signal.

10. The GOA circuit of reducing power consumption according to claim 9, wherein both the low voltage level of the clock signal and the constant low voltage level are −7V.

11. The GOA circuit of reducing power consumption according to claim 9, wherein in the GOA unit circuit of the first stage, both the gate and the source of the eleventh thin film transistor receive a scan activation signal.

12. The GOA circuit of reducing power consumption according to claim 9, wherein in the GOA unit circuit of the last stage, both the gate of the thirty-first thin film transistor and a gate of the fifty-first thin film transistor receives a scan activation signal.

13. The GOA circuit of reducing power consumption according to claim 9, wherein a channel width of the twenty-first thin film transistor is 500 μm, and a channel width of the twenty-second thin film transistor is 2000 μm.

* * * * *